US007993173B2

(12) United States Patent
Acampora

(10) Patent No.: US 7,993,173 B2
(45) Date of Patent: Aug. 9, 2011

(54) MARINE DRIVE SYSTEM WITH PARTIALLY SUBMERGED PROPELLER

(75) Inventor: Brunello Acampora, Naples (IT)

(73) Assignee: Flexitab S.R.L., Naples (IT)

( * ) Notice: Subject to any disclaimer, the term of this patent is extended or adjusted under 35 U.S.C. 154(b) by 179 days.

(21) Appl. No.: 12/083,203

(22) PCT Filed: Oct. 6, 2006

(86) PCT No.: PCT/EP2006/067157

§ 371 (c)(1),
(2), (4) Date: Apr. 16, 2008

(87) PCT Pub. No.: WO2007/042483

PCT Pub. Date: Apr. 19, 2007

(65) Prior Publication Data

US 2009/0124145 A1 May 14, 2009

(30) Foreign Application Priority Data

Oct. 7, 2005 (EP) ..... 05425705

(51) Int. Cl.
*B63H 1/18* (2006.01)

(52) U.S. Cl. ..... 440/66

(58) Field of Classification Search ..... 440/66, 440/67

See application file for complete search history.

(56) References Cited

U.S. PATENT DOCUMENTS

| | | | | |
|---|---|---|---|---|
| 3,422,789 | A | 1/1969 | Wynne et al. | |
| 3,742,895 | A | 7/1973 | Horiuchi | |
| 4,553,945 | A * | 11/1985 | Foster | 440/51 |
| 5,667,415 | A | 9/1997 | Arneson et al. | |
| 2004/0147181 | A1 * | 7/2004 | Elizondo | 440/38 |
| 2006/0019556 | A1 * | 1/2006 | Baldwin | 440/37 |

FOREIGN PATENT DOCUMENTS

| | | | | |
|---|---|---|---|---|
| DE | 30 42 197 | A1 | 6/1982 | |
| GB | 2033324 | A * | 5/1980 | 440/66 |
| GB | 246635 | | 9/1994 | |

OTHER PUBLICATIONS

International Search Report for PCT/EP2006/067157 dated Feb. 5, 2007.

* cited by examiner

*Primary Examiner* — Stephen Avila
(74) *Attorney, Agent, or Firm* — Nixon & Vanderhye P.C.

(57) ABSTRACT

A marine drive system (1) with a partially submerged propeller located at the transom of a boat comprising, for each propeller (2), a forward-opened shroud (20), positioned above the propeller (2), such as to define, between it and the water level, a channel (23) extending longitudinally and having, at the propeller (2), a cross-section whose area decreases from the transom (30).

9 Claims, 5 Drawing Sheets

MARINE DRIVE SYSTEM WITH PARTIALLY SUBMERGED PROPELLER

This application is the U.S. national phase of International Application No. PCT/EP2006/067157 filed 6 Oct. 2006 which designated the U.S. and claims priority to 05425705.0 filed 7 Oct. 2005, the entire contents of each of which are hereby incorporated by reference.

The present invention relates to a marine drive system with a partially submerged propeller, i.e. a drive system having a propeller operated in a partially submerged state, in particular at the nominal cruise speed designed for the system, so as to have the propeller blades aerated and piercing the water surface at that speed.

Several types of the above-specified system are known, to be found, e.g., in the Italian patent No. 1,184,406 and in the PCT applications Publ. No. WO 92/06000 and WO 96/40550. In general, such a system provides one or more propellers fitted on the transom of a boat, with the propeller shaft projecting aft.

The propeller is intended to remain only partially submerged during its operation, producing a localized propulsive flow at the water surface. Such a system, though acceptable on principle on any watercraft, finds its preferred application in the instance of high-speed boats for competition, sporting and yachting.

In the above-mentioned patent publications, the drive system provides for them to have, at each propeller, a shroud partially encircling the propeller itself, basically in order to contain and direct the water flow comprising helical volutes.

In particular, the PCT application Publ. No. WO 96/40550 and U.S. Pat. No. 5,667,412 A describe shrouds partially encircling the propeller and having, viewed along a circumferential line and along the path of the propeller blades, a first leading end, a median portion and a second trailing end. The leading end gradually approaches the propeller volute, the median portion is adjacent and near thereto and the trailing end gradually departs therefrom.

However, in the abovementioned cases the shroud forms a substantially cylindrical tubular structure at the propeller and the overall efficiency of the drive system is not optimized in terms of fluid mechanics, it being not suitably shaped, but rather comparable to a plane plate in the longitudinal direction.

DE 30 47 192 A discloses a propelling system having a propeller encased in a tubular shroud forming a closed environment between the propeller and the transom and at both sides of the propeller. Thus, the propeller operation intakes water, so as to have the propeller operating completely immersed, even when, in operation, the propeller itself raises over the water level.

Similar arrangements are known from GB 246,635-U.S. Pat. Nos. 3,422,789 and 3,742,895. In these propelling system, the propeller is operated in an immersed condition, so as to produce a water jet thrusting the boat, and it cannot be qualified as a partially submerged propeller.

Instead, in a marine drive system with a true partially submerged propeller, the propeller blades pierce the water surface so as to thrust the boat ahead, and the propeller is aerated while in operation, in particular at the fastest speeds.

The technical problem underlying the present invention is to provide a drive system of the latter kind overcoming the drawbacks mentioned with reference to the known related art, wherein the shroud is at least forward opened, so as to avoid the water intake at the propeller and to allow it to be operated in a partially submerged condition.

Such a problem is solved by a marine drive system with at least one partially submerged propeller located at the transom of a boat comprising, for each propeller, a forward and/or laterally opened shroud positioned above the propeller such as to define, at the propeller, between the lower surface thereof and a horizontal plane surface corresponding to the ideal immersion line of the propeller, a channel, extending longitudinally and having, at the propeller, a cross-section area decreasing from the transom.

Hence, said shroud is suitably shaped along the longitudinal axis and therefore is capable of advantageously modifying the flow generated by the propeller itself.

In fact, the main advantage of the drive system according to the present invention lies in allowing a more effective directing of the propulsive flow, leading to an appreciable increase of efficiency in the drive and steerability, for any nominal cruising speed envisaged for the boat.

In this connection, the ideal immersion line can be defined as the ideal propeller submergence at, or about, the either design, nominal or economical cruise speed of the vehicle.

On fully displacement crafts, designed for relatively low speeds, this line might be close or equivalent to the static waterline of the vessel. This kind of crafts generally show a completely or mostly dry transom, positioned above the static waterline; therefore, in this case, even at rest the propeller might be only partially submerged.

Conversely, on semi-displacement or fully planing vessels, usually achieving higher relative speeds than the above mentioned displacement type crafts, a bodily rise of the hull above the water surface is generally expected as the cruise speed increases, due to the hydrodynamic lift generated by the hull itself as it travels through water. This latter kind of faster crafts is generally further designed with an immersed transom, which becomes dry as speed increases towards the design operating speed of the vehicle; for this reason, on semi-displacement or fully planing vessels, the propeller ideal immersion line might lay well below the static waterline of the vessel at rest, since it is generally along the ideal extension aft of the hull bottom surface. Hence, on semi-displacement or fully planing vessels, when at rest or at very low speeds, the propeller might be fully submerged, but shall in any case promptly pierce the water surface and operate in a partially submerged mode, as described in the context, as speed increases to approach the intended design speed or the nominal speed.

According to a preferred embodiment of the invention, the shroud has two opposite shroud ends, one or both of them is maintained elevated with respect to said ideal immersion line of the propeller, i.e. in operation the water level.

The present invention will hereinafter be described according to three preferred embodiments thereof, given by way of non-limiting example with reference to the attached drawings, wherein.

In each of the embodiments of marine drive system that will be described hereinafter, alike number references denote alike or functionally analogous components.

Whilst a single-propeller system is shown, evidently the system could employ plural propellers, e.g. a pair thereof, mirroring or not mirroring, for each propeller, the structure that will be described hereinafter.

Figure 1:
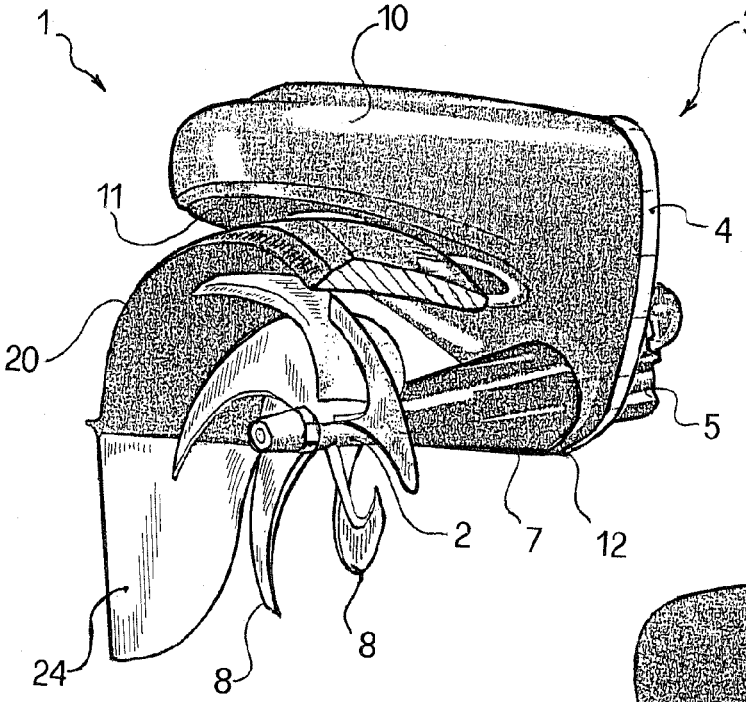
FIG. 1 shows a partially sectional perspective view of a first embodiment of the drive system according to the invention.
Figure 2:
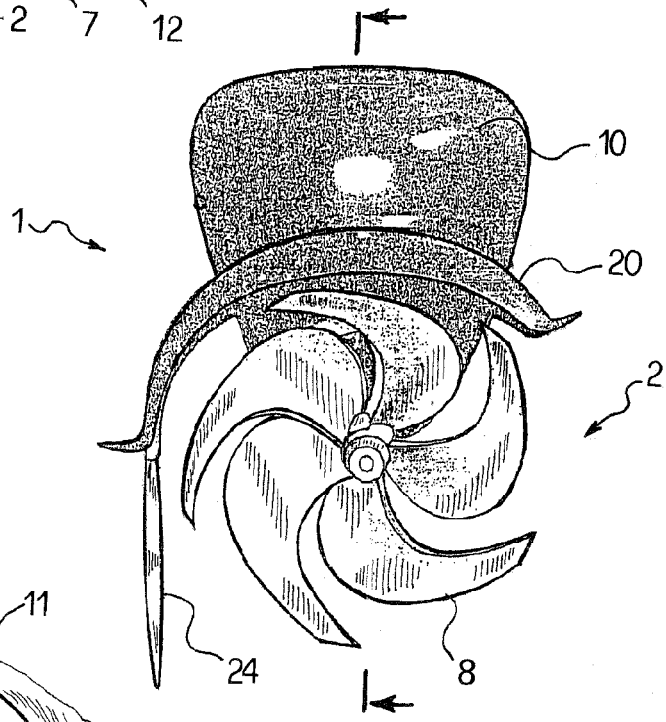
FIG. 2 shows a front view, i.e. taken aft, of the drive system of FIG. 1.
Figure 3:
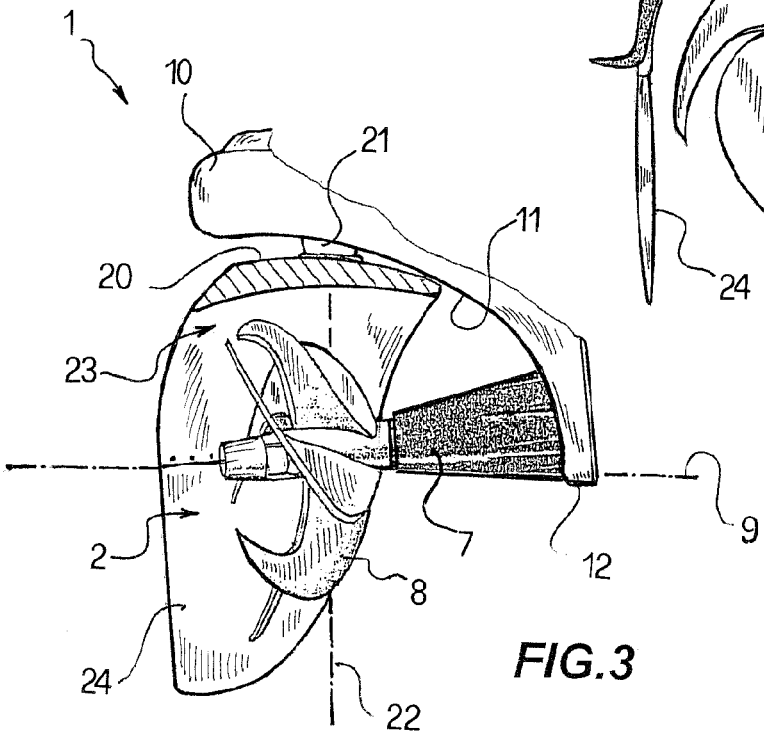
FIG. 3 shows a longitudinal and partially sectional view, taken along line A-A of FIG. 2, of the drive system of FIG. 1.

Referring to FIGS. 1 to 3, a first embodiment of a marine drive system with partially submerged propellers is indicated by 1. It comprises a propeller 2 and a support structure 3 that in turn has a connection plate 4, apt to be secured to the transom of a boat.

The connection plate 4 has a connection 5 for the propeller shaft of an inboard engine positioned inside the boat.

The plate 4 comprises an access port 6 through which the engine exhaust gases are emitted.

At the connection plate 4, the system has, in correspondence of the transmission of motive power to the propeller 2, a thrust-bearing stem tube 7, fitted with a propeller shaft. Said stem tube 7 concomitantly performs the functions of: wet seal, i.e. it prevents the ingress of water into the boat; thrust-bearing, i.e. it transfers the propeller-generated thrust to the case 10 and to the bottom of the connection plate 12; and structural support of the axis of the propeller 2. In particular, this latter function of structural support is performed by means of a single front linkage to the bottom of the connection plate 4, without any stationary or hydraulic intermediate support.

The propeller 2, e.g. with five blades 8 suitably shaped for this type of propeller, is secured to the propeller shaft. In any case, the shape and the number of the blades are selected in connection with the design performance of the boat.

For each propeller, there can be singled out a horizontal plane surface corresponding to the ideal draft line 9 of the propeller.

For the sake of clarity, on semi-displacement or fully planing vessels, achieving higher relative speeds and typically suitable for adopting a marine drive system according the present invention, a bodily rise of the hull above the water surface is generally expected as speed increases to the nominal cruise speed or more, due to the hydrodynamic lift generated by the hull itself as it travels through water.

The ideal immersion line as mentioned herein is the design propeller submergence at, or about, the nominal operating speed of the boat incorporating the marine drive system herein described.

Of course, the propeller ideal immersion line might lay well below the static waterline of the vessel at rest, since it is generally along the ideal extension aft of the hull bottom surface. Hence, on semi-displacement or fully planing vessels, when at rest or at very low speeds, the propeller might be fully submerged, but shall in any case promptly pierce the surface and operate in a partially submerged mode, as herein described, as the cruise speed increases to approach the intended design speed.

From the connection plate 4 there extends a suitably modelled projecting case 10 overlapping the region of the propeller 2. Such a case 10 is sealed onto the plate 4, so as to prevent the water to get therein. The case 10 has, at the region of the propeller, a curved surface 11 connecting to the transom, i.e. with the bottom end 12 of the connection plate 4. The curved surface 11 is shaped so as to gradually direct the propulsive flow of the propeller driven astern, suitably orienting it in order to maximize its effectiveness at such a speed. Thus, the efficiency of the drive, astern and in handling, is significantly improved.

The system 1 comprises a shroud 20 connected, through a joint 21, to the projecting case 10. Such a shroud 20 may be rotated about a substantially vertical axis 22. In the present embodiment, the shroud 20 is formed by a curved plate.

According to the invention, the shroud 20 is basically positioned above the propeller 2 and substantially kept above the water level, shaped so as to envelop the region of the propeller 2 along a significant circular sector between two opposite shroud ends.

In the following, the side of the shroud 20 positioned between the propeller 2 and the transom, toward the boat's prow will be mentioned as forward side delimited by a leading edge. Consequently, the opposite side of the shroud 20 will be mentioned as aft side delimited by a trailing edge.

In general, the position and the connection to the case 10 or to the transom are designed to have the forward side of the shroud 20 receiving air and possibly exhaust gases, so as to maintain the propeller 2 aerated and to avoid the intake of the water by the upper region of the propeller 2, the latter thus remaining, in operation, always in a partially submerged condition.

Further, the shroud 20 is positioned so as to intercept the wake flow generated by the propeller and, thanks to the peculiar shape of the former, at the propeller the flow is suitably directed to maximize its effectiveness. Between the shroud 20, i.e. a lower surface thereof, and a horizontal plane surface corresponding to the ideal immersion line 9 of the propeller 2 lies a channel 23, extending longitudinally and having a cross-section whose area, at least at the propeller 2, decreases according to a direction from the transom.

In particular, the longitudinal profile of the shroud 20 is curved so as to have, at least at the propeller 2, the lower surface thereof approaching the axis of the propeller 2.

Figure 4:
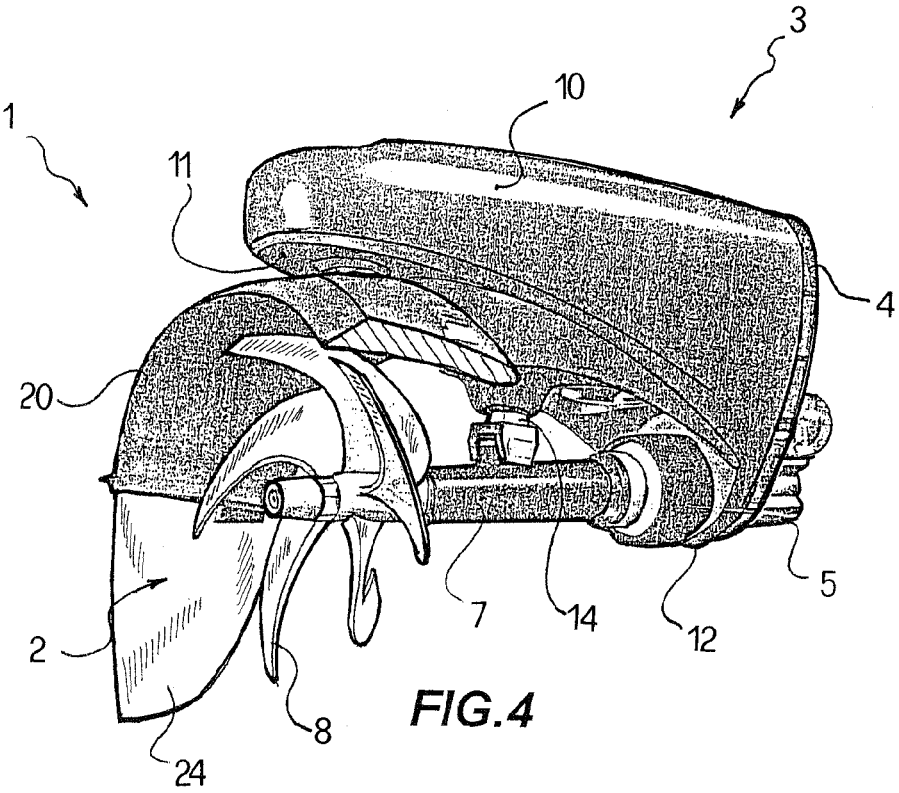
FIG. 4 shows a perspective view of a second embodiment of the drive system according to the invention.

This shape effect is achieved by assuring that, along said direction of flow, the bottom surface 25 of the shroud 20 varies its position with respect to the axis of the propeller 2 (FIG. 4).

In operation, as the propeller is rotated and the boat travels at the nominal speed thereof, the bottom surface of the shroud 20 acts upon the mixed flow of water and air generated aftward by the propeller, in the region above the ideal immersion line.

It is again pointed out that the forward side of the shroud, and/or the shroud ends, are shaped so as to allow the feeding of air and/or gases (for instance, the exhaust gases from the boat engine), i.e. an adequate passage of air and/or gases through the propeller blades as they rotate through the region above the ideal immersion line.

Laterally, the shroud 20 extends vertically with a rudder blade 24, positioned so as to remain well-immersed. Thus, the shroud 20 has an opposite shroud end maintained elevated with respect to the water level, enhancing the aeration of the propeller.

Hence, by rotating the shroud 20 it is achieved the dual effect of directing the propulsive flow, since also the longitudinal axis of the channel 23 is rotated.

Concomitantly, the rotation of the shroud 20 actuates the rudder 24. Therefore, into the projecting case there will be housed the actuators, e.g. wire-driven, hydraulic, etc., of the shroud 20 and of the rudder 24. The case 10, by being watertight, protects these actuators which accordingly do not need specific details.

This embodiment (FIGS. 1, 2 and 3) with a short propeller shaft is suitable for work and yachting boats, apt to sail in displacement, pre-planing and planing. The speeds of the boats to which these drives are aimed are slow and medium-fast.

Figure 5:
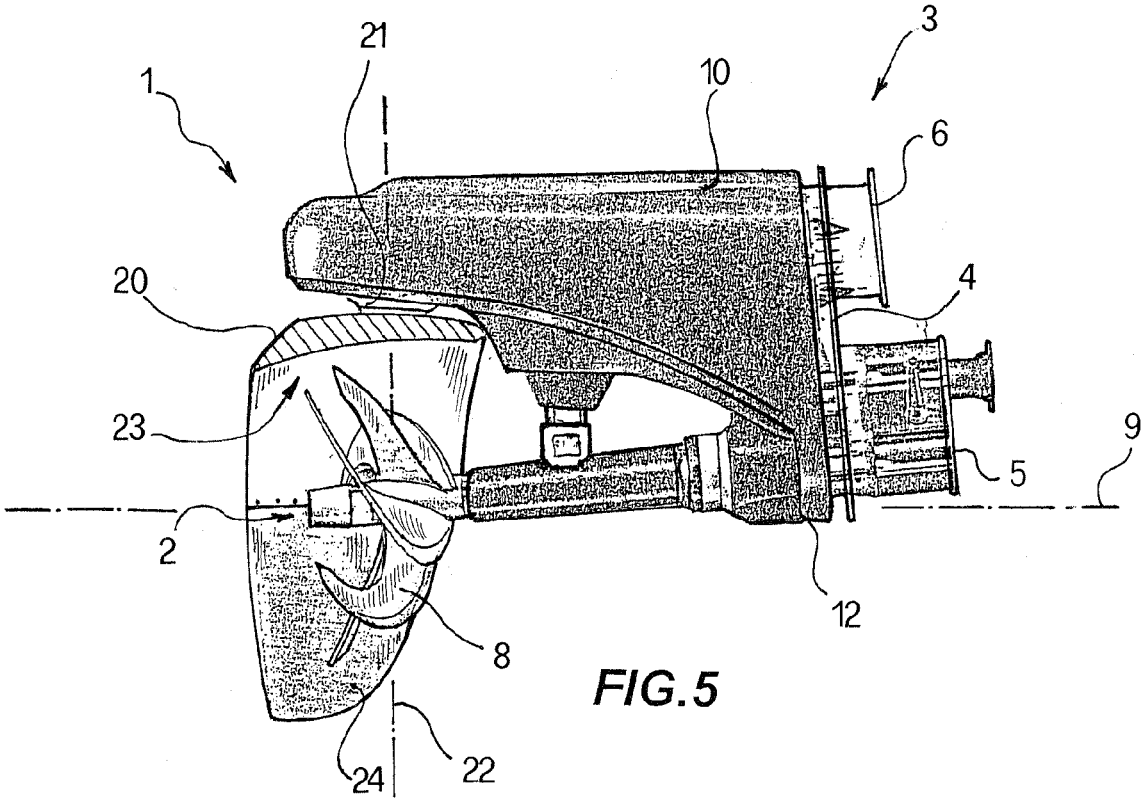
FIG. 5 shows a longitudinal and partially sectional view of the drive system of FIG. 4.

With reference to FIGS. 4 and 5, it is described a second embodiment of the system according to the invention.

With respect to the preceding one, the projecting case 10 and the propeller shaft, which in this instance swivels on the vertical plane adjusting the immersion of the propeller, are more extended. This typology is suitable for planing-bottom work and yachting boats suitable for medium-high speeds.

The tubular case 7, containing the propeller shaft, is connected to means for varying the position of the propeller shaft, in this embodiment of the type with one active hydraulic cylinder 14, capable of taking up stresses involving the shaft, in any direction of occurrence, and of actively modifying the height of the propeller, e.g. to adjust it to different loads or speeds of the boat.

In this embodiment, said means for varying the position of the propeller shaft is positioned below the projecting case, in a zone of the curved surface comprised between the shroud 20 and the bottom end 12 of the connection plate 4.

The functionality of the shroud 20 and of the rudder 24 is identical to that described with reference to the first embodiment. This shroud is opened at the forward side thereof and has one of the shroud ends maintained elevated with respect to the water level, so as to ensure the correct aeration of the propeller.

However, it is understood that the projecting case 10, apart from housing the actuators of the shroud 20, will contain, shielding them from water, the actuators and the connections required to said means for varying the position of the propeller shaft.

As in the preceding embodiment, the shroud 20 is positioned so as to define, between the lower surface thereof and a horizontal plane surface corresponding to the ideal immersion line 9 of the propeller 2, a channel 23 running longitudinally and having a cross-section whose area, at least at the propeller, decreases from the transom.

In particular, the longitudinal profile of the shroud 20 is curved so as to have, at least at the propeller 2, the lower surface thereof approaching the axis of the propeller 2.

This shape effect is achieved by assuring that, along said direction, the bottom surface 25 of the shroud 20 gradually nears to the axis of the propeller 2 (FIG. 5).

Figure 6:
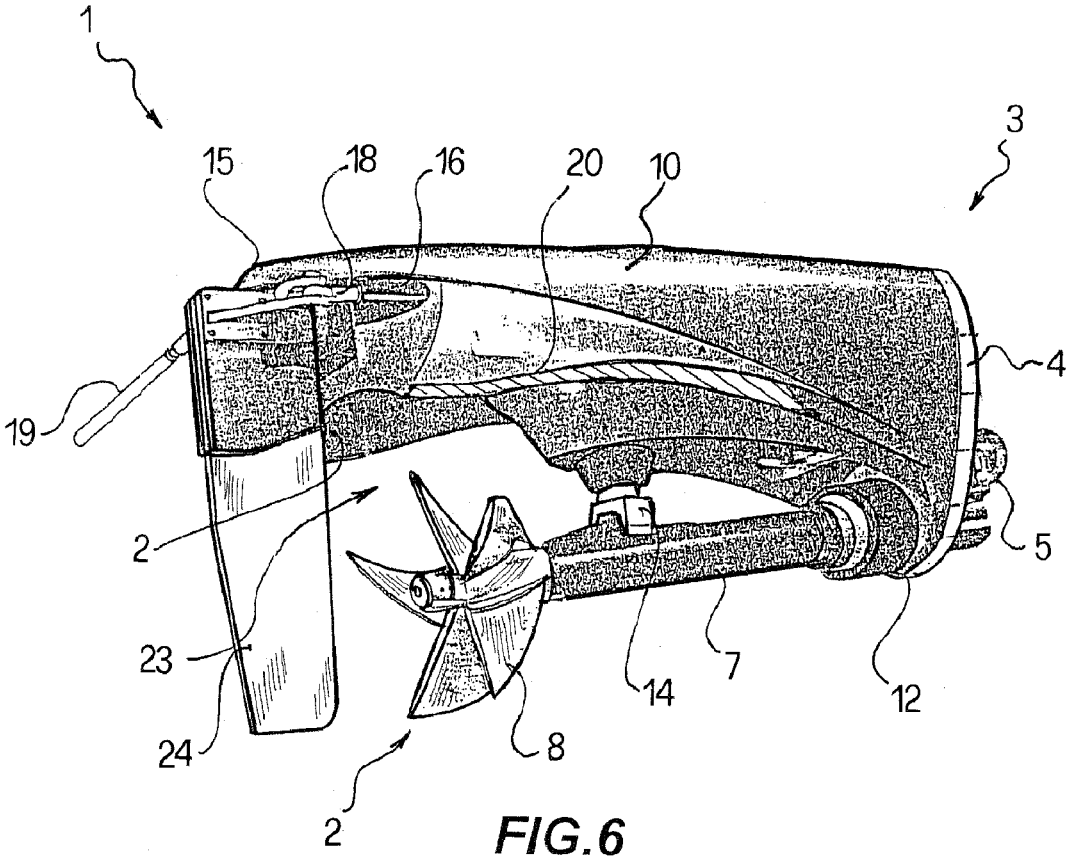
FIG. 6 shows a perspective view of a third embodiment of the drive system according to the invention.
Figure 7:
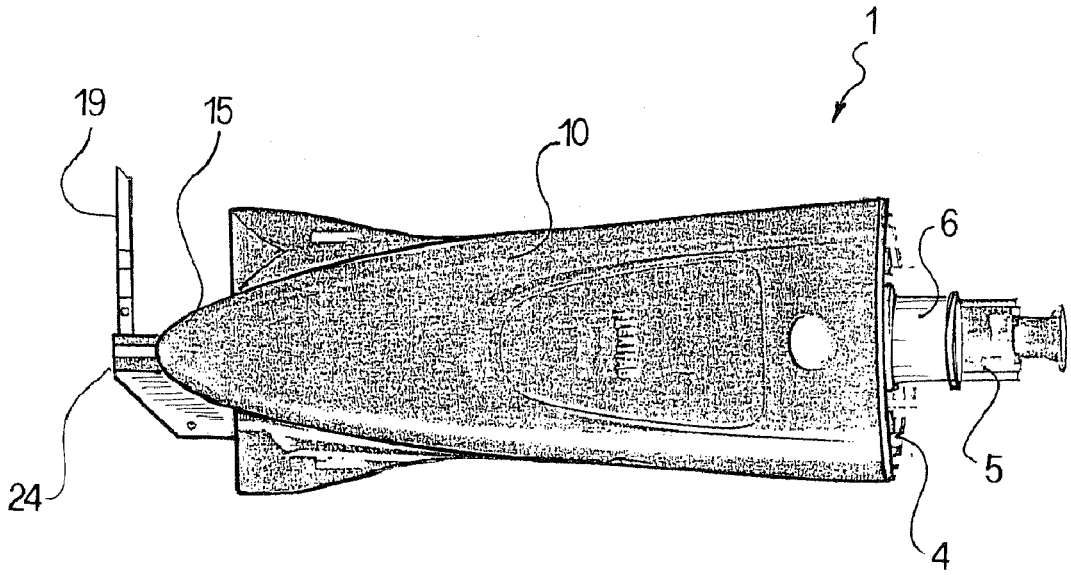
FIG. 7 shows a top plan view of the drive system of FIG. 6.

Referring to FIGS. 6 and 7, it is described a third embodiment of the system according to the invention.

With respect to the preceding ones, the projecting case 10 and the propeller shaft are even more extended. This typology is suitable for particularly fast boats, like, e.g., competition boats.

In this embodiment as well there is the means for varying the position of the propeller shaft, positioned alike the aforedescribed one.

At the distal end 15 of the projecting case 10, there is a rudder blade 24', hinged on a vertical axis at said distal end of the case 10. From the latter there are connected the wire drives 18 for steering the rudder. There may be provided a further wire drive 19 connecting to a rudder of an adjacent drive system 1.

The bottom curved surface 11 of the case 10, in an area located at the propeller, is shaped so as to define a shroud 20 that, in the present embodiment, has a curved plate enveloping the region of the propeller 2 along a significant circular sector.

In this embodiment, the shroud 20, though performing the same functions described in the foregoing, is stationary, integral to the projecting case 10 and to the transom. The rudder is unconstrained thereto. Anyway, the case 10 is secured to the transom in a position significantly far from the water level, so as to have the shroud portion thereof forward opened, thus avoiding the intake of water at the upper region of the propeller.

In this embodiment, both the shroud ends of the shroud portion 20 are maintained elevated with respect to the water level.

The longitudinal profile of the shroud 20 is curved so as to have, at least at the propeller 2, the lower surface thereof approaching the axis of the propeller 2.

Figure 8:
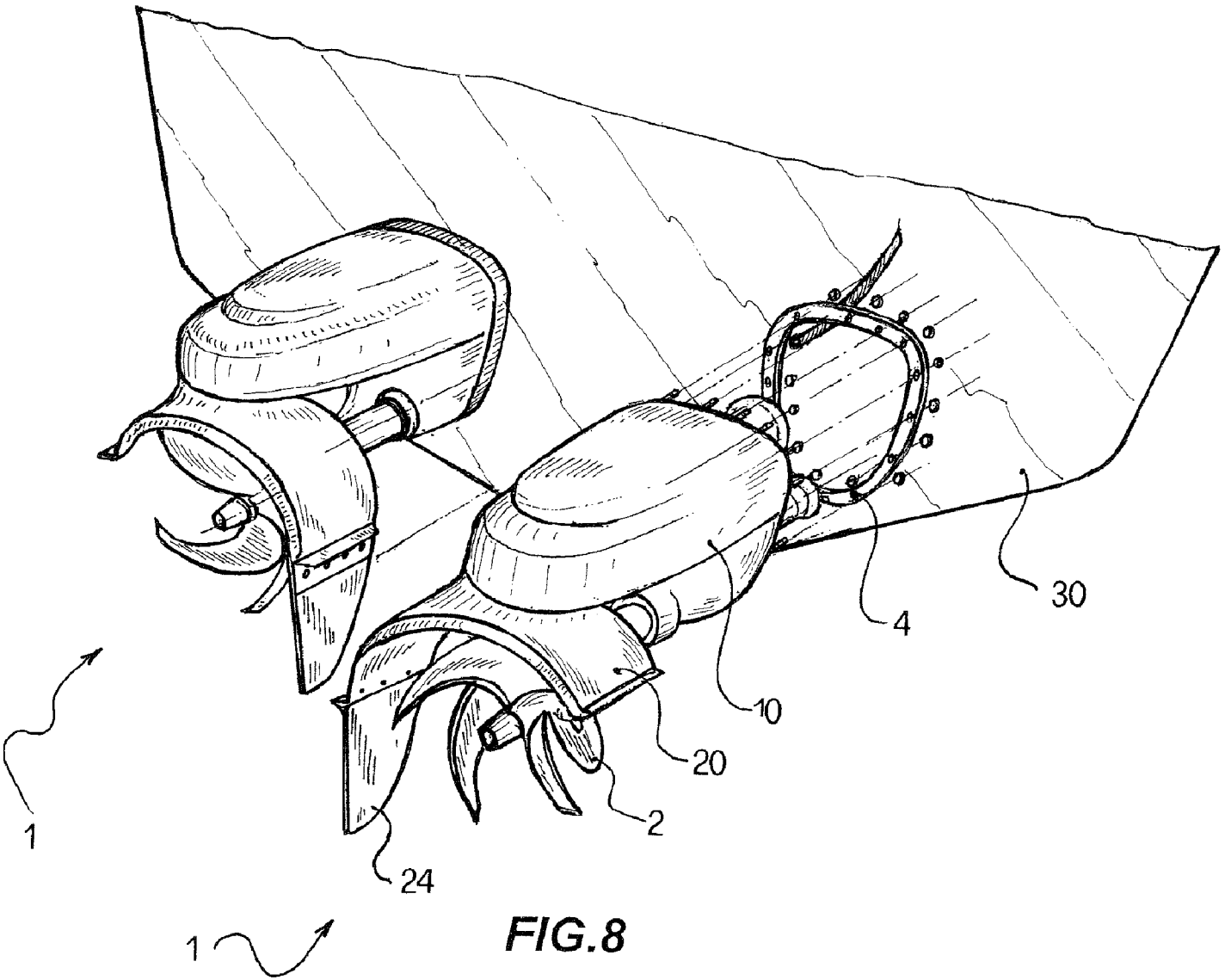
FIG. 8 shows a perspective view of a drive system with a pair of propellers.

Referring to FIG. 8, it is illustrated the mounting of marine drive systems 1 to the transom 30 of a boat (not shown).

It will be noted that the connection plate 4 is apt to be mounted onto the surface of the transom 30 simply by adhering thereto, compatibly to the inclination of said surface.

The latter will have an aperture allowing the connection of the propeller shaft to the axis of the propeller itself, and of all the required actuators transiting internally to the projecting case 10.

Thus, the mutual positioning between connection plate 4 and propeller shaft has already been set and adjusted in manufacture; hence, no further adjustments are needed when fitting the system 1 to the transom 30.

It is understood that the propulsive system 1 described with reference to the three embodiments reported above may be applied, with some variants and adjustments not depending on the inventive concept, to any boat, even of a displacement type, exploiting anyhow the driving potential of the partially submerged propeller typology.

Figure 9:
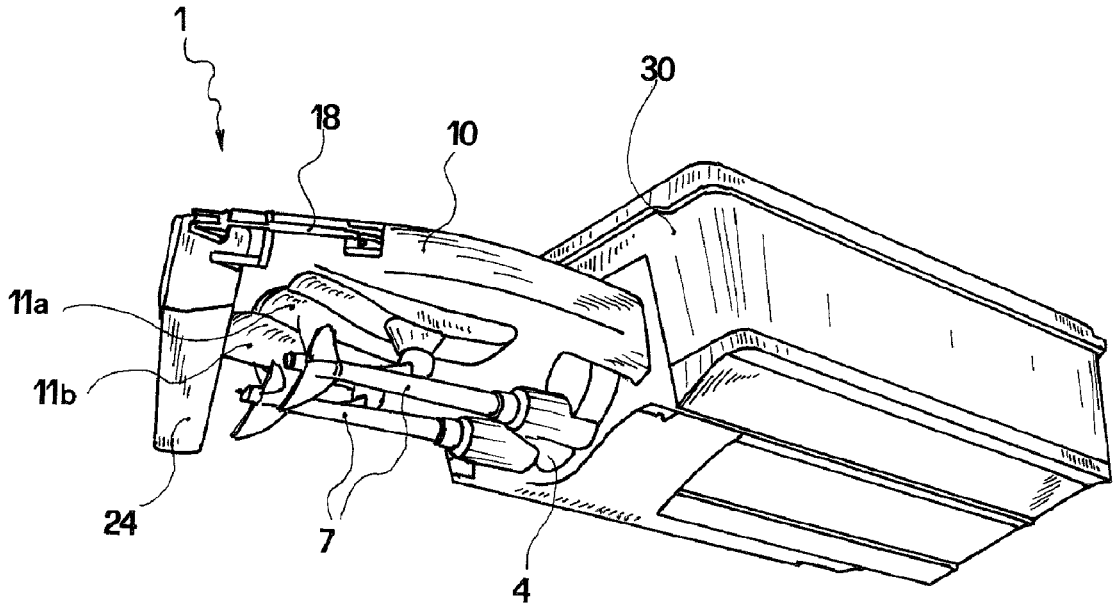
FIGS. 9 and 10 show perspective views of a multiple propeller solution adopting the same inventive principle underlying the present invention.
Figure 10:
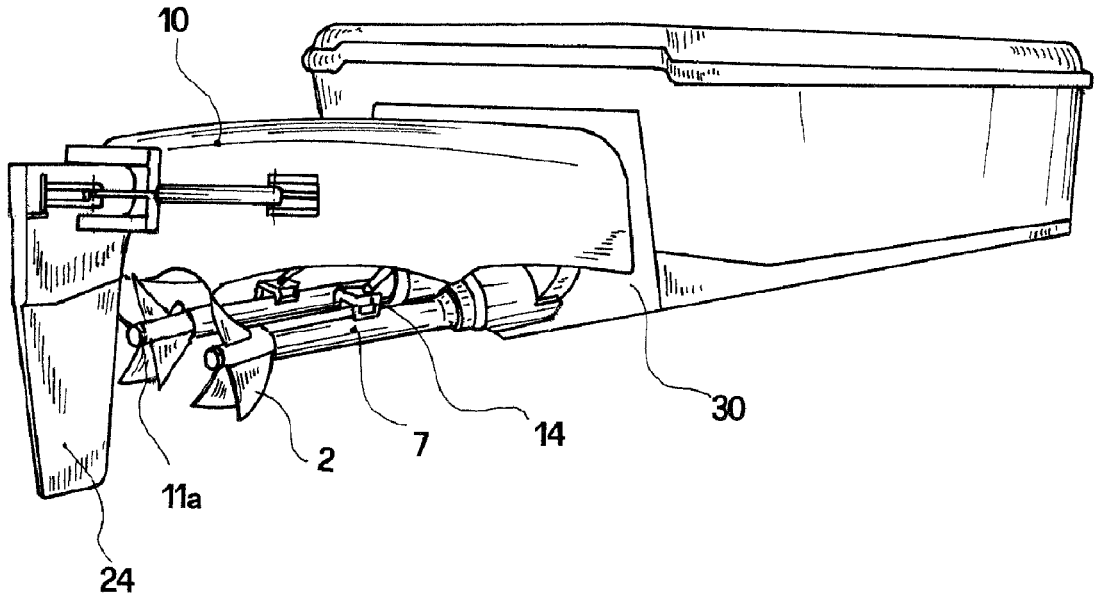

Referring to FIGS. 9 and 10, there may be envisaged variants to said system providing installations of a single case 10 apt to house two or more propeller systems and their axes. In this case as well, the rudder or rudders 24' will always be secured to the case 10 and could be of a different number with respect to the propellers.

The case 10 will have, for each propeller, a corresponding curved surface 11*a*, 11*b* performing the abovedescribed functions.

To the abovedescribed drive system a person skilled in the art, in order to satisfy further and contingent needs, could effect several further modifications and variants, all however encompassed in the protective scope of the present invention, as defined by the appended claims.

The invention claimed is:

1. A marine drive system with a partially submerged propeller located at the transom of a boat comprising, for each propeller, a forward and/or laterally opened shroud positioned above the propeller, such as to define, at the propeller between a lower surface thereof and a horizontal plane surface corresponding to the ideal immersion line of the propeller, a channel extending longitudinally and having at the propeller a cross-section area decreasing from the transom, wherein the shroud has a two shroud ends, one or both of them maintained elevated with respect to the ideal immersion line of the propeller, and further comprising at a distal end of the projecting case a rudder blade being hinged on a vertical axis.

2. The drive system according to claim 1, wherein a longitudinal profile of the shroud is curved so as to have, at least at the propeller, a lower surface thereof approaching an axis of the propeller the shroud being basically constituted by a curved plate, shaped so as to envelop the region of the propeller along a significant circular sector.

3. The drive system according to claim 1, comprising a support structure that in turn has a connection plate, apt to be secured to the transom of a boat, wherein the mutual positioning between connection plate and a propeller shaft of the propeller has already been set and adjusted in manufacture.

4. The drive system according to claim 2, comprising a support structure having a connection plate from which there extends a projecting case overlapping the region of the propeller and supporting or being shaped so as to form said shroud.

5. The drive system according to claim 4, wherein the bottom curved surface of the projecting case, in an area located at the propeller, is shaped so as to define said shroud having a curved plate with a suitably shaped surface enveloping the region of the propeller along a significant circular sector.

6. The drive system according to claim 4, wherein said projecting case is sealed, so as to prevent the water to get therein.

7. The drive system according to claim 4, wherein said projecting case has, at the region of the propeller, a curved surface shaped so as to gradually direct the propulsive flow of the propeller driven astern, the propulsive flow being therefore directed in the direction of the transom, below the keel, though maintaining a significant horizontal thrust component.

8. The drive system according to claim 4, having a tubular case, containing the propeller shaft, which is connected to means for varying the position of the propeller shaft.

9. The drive system according to claim 8, wherein said means for varying the position of the propeller shaft is positioned below the projecting case, in a zone of the curved surface comprised between the shroud and the transom.

* * * * *